US012012704B2

(12) United States Patent
Happonen et al.

(10) Patent No.: US 12,012,704 B2
(45) **Date of Patent: *Jun. 18, 2024**

(54) VEHICLE ASSISTED WORKING DEVICE, CLEANING SYSTEM, AND METHOD USING THE SAME

(71) Applicant: Trombia Technologies Oy, Kuopio (FI)

(72) Inventors: Jaakko Happonen, Kuopio (FI); Petri Heikkinen, Kuopio (FI)

(73) Assignee: TROMBIA TECHNOLOGIES OY, Kuopio (FI)

( * ) Notice: Subject to any disclaimer, the term of this patent is extended or adjusted under 35 U.S.C. 154(b) by 73 days.

This patent is subject to a terminal disclaimer.

(21) Appl. No.: 17/248,237

(22) Filed: Jan. 15, 2021

(65) Prior Publication Data

US 2021/0164180 A1 Jun. 3, 2021

Related U.S. Application Data

(60) Continuation of application No. 16/031,793, filed on Jul. 10, 2018, now Pat. No. 10,920,385, which is a (Continued)

(30) Foreign Application Priority Data

Jan. 8, 2015 (FI) ..... 20155008

(51) Int. Cl.
*E01H 1/08* (2006.01)
*A47L 9/04* (2006.01)

(Continued)

(52) U.S. Cl.
CPC ..... *E01H 1/0872* (2013.01); *A47L 9/0477* (2013.01); *A47L 9/102* (2013.01); *A47L 11/24* (2013.01); *E01H 1/056* (2013.01)

(58) Field of Classification Search
CPC ... E01H 1/0872; E01H 1/0809; E01H 1/0863; E01H 1/08–089
See application file for complete search history.

(56) References Cited

U.S. PATENT DOCUMENTS 4,001,908 A 1/1977 Franklin
4,206,530 A 6/1980 Kroll et al.

(Continued)

FOREIGN PATENT DOCUMENTS

CA 2317100 A1 * 2/2001 ..... E01H 1/0872
CN 1186761 A 7/1998

(Continued)

OTHER PUBLICATIONS

FI Search Report, dated Feb. 18, 2015, from corresponding FI Application No. 20155008.

(Continued)

*Primary Examiner* — Bryan R Muller
(74) *Attorney, Agent, or Firm* — NIXON & VANDERHYE

(57) ABSTRACT

A mobile collection device including a vehicle assisted working device for cleaning surfaces, and an autonomously self-driving robot vehicle. The working device includes a brush for detachment of extraneous material from the surface, a blower configured to provide an underpressure for a suction of the detached material into the air flow from the surface, and a cyclone configured to separate material from the air flow. The blower is configured to provide an overpressure and return of the separated air to the surface. The brush is configured to rotate counter-wise to a forward movement direction of the working device. The working device is configured such that the spot is treated in the following order: the blower provides the underpressure for the suction of the detached materials, the counter-rotating brush brushes the spot, and the blower provides the over- (Continued)

pressure and return of the separated air to the surface via an air-knife.

13 Claims, 3 Drawing Sheets

Related U.S. Application Data division of application No. 14/991,342, filed on Jan. 8, 2016, now abandoned.

(51) Int. Cl.

| | |
|---|---|
| ***A47L 9/10*** | (2006.01) |
| ***A47L 11/24*** | (2006.01) |
| ***E01H 1/05*** | (2006.01) |

(56) References Cited

U.S. PATENT DOCUMENTS

| | | | | | |
|---|---|---|---|---|---|
| 4,310,944 | A * | 1/1982 | Kroll | A47L 11/40 | 15/340.4 |
| 6,122,797 | A * | 9/2000 | Vanderlinden | E01H 1/0872 | 15/340.1 |
| 6,154,922 | A * | 12/2000 | Vanderlinden | A47L 11/24 | 15/340.3 |
| 7,877,838 | B2 * | 2/2011 | Bos | E01H 1/0872 | 15/345 |
| 2003/0079310 | A1 * | 5/2003 | Lenzmeier | E01H 1/0863 | 15/340.1 |
| 2009/0106930 | A1 | 4/2009 | Bos | | |
| 2009/0113856 | A1 * | 5/2009 | Cooper | E01H 1/053 | 55/283 |
| 2009/0229234 | A1 | 9/2009 | Ettrich | | |

FOREIGN PATENT DOCUMENTS

| | | | | |
|---|---|---|---|---|
| CN | 1221055 | A | 6/1999 | |
| CN | 103338689 | A | 10/2013 | |
| CN | 203252587 | U | 10/2013 | |
| CN | 103764004 | A | 4/2014 | |
| EP | 0 538 238 | A1 | 4/1993 | |
| EP | 2 230 357 | A2 | 9/2010 | |
| FR | 400532 | A | 7/1909 | |
| GB | 755381 | A | 8/1956 | |
| GB | 797833 | A | 7/1958 | |
| GB | 1272277 | A | 4/1972 | |
| NL | WO2006046863 | A1 * | 5/2006 | E01H 1/05 |
| WO | 2006/046863 | A1 | 5/2006 | |

OTHER PUBLICATIONS

European Search Report and Search Opinion, dated Apr. 19, 2016, from corresponding EP Application No. EP 16150046.7.

Non-Final Office Action issued in co-pending U.S. Appl. No. 16/582,896 dated Mar. 30, 2020.

Communication issued in European Patent Application No. 17 210 172.7 dated Jan. 21, 2019.

Communication issued in European Patent Application No. 17 210 172.7 dated Oct. 2, 2019.

European Search Report issued in European Patent Application No. 17 210 172.7 dated May 9, 2018.

Office Action issued in Chinese Patent Application No. 202111007259.5 dated Jan. 19, 2022.

Zhang, "Section 20 Sweeping Vehicle," Building mechanical engineering, Apr. 30, 1998, pp. 383-385.

Office Action issued in Chinese Patent Application No. 202111005950.X dated Feb. 16, 2022.

* cited by examiner

VEHICLE ASSISTED WORKING DEVICE, CLEANING SYSTEM, AND METHOD USING THE SAME

FIELD OF INVENTION

The Invention relates to cleaning technology, in more specific, to removal of extraneous materials from a surface as indicated in the preamble parts of independent claims directed to a working device, method of cleaning surfaces, and a system for cleaning surfaces.

BACKGROUND TECHNOLOGY

It is desirable to keep streets, squares and other market places clean. There are cleaning vehicles dedicated to cleaning such surfaces with rotating brushes. One serious problem in the cleaning is the dust which is re-suspended into the air from the surfaces while doing the cleaning by brushing. This is inconvenient for the people living in the area, considered also as a potential health risk, especially for people that are allergic.

The amount of air-borne dust has been reduced conventionally by showering the surface to be cleaned with water and then brushing the wet mass into a vessel of the cleaning vehicle. This is facilitated with various kinds of cleaning devices which are most often car-borne type, operable during the movement of the vehicle into which the device is strictly integrated.

From another point of view, a problem is the weight of the water to be used in such a surface treatment, which causes fuel consumption of the vehicle and thus the ratio in maintenance versus in duty would be at least partly non-economic. A corollary problem of the water weight is the reduced amount of the debris that can be collected before a new round of collection. The after-treatment that has to be made is made on high water content basis when/after emptying the vessel of the collected debris.

A further improvement to the dust problem is to use suction in a system to suck the dust away. However, the dust cannot be emitted back into the air, but should be rather removed in a regenerative way treating the air as a dust particle carrier. Filtration of large amounts of air-borne particles need a large surface area for the bag-house to be used for the filtration, the filtering unit being relatively large in mechanical size. Also the pump or a blower to maintain sufficient pressure drop over the often clogging bag-house have to be quite large and heavy. Such vehicle-born systems lead to large design and tight integration, consequently making the devices expensive and only for one purpose-oriented.

SUMMARY OF THE INVENTION

It is an object of the invention to provide a new technique for cleaning efficiently and economically, by which the above problems of prior art are decreased or avoided. The object is achieved with embodiments of the invention.

According to an aspect of the invention the working device for cleaning streets and similar surfaces from extraneous materials, such as sands, is characterized by claim 1.

Some preferable embodiments of the invention are described in the dependent claims.

With the working device according to the invention it is possible to provide efficient cleaning of surfaces without using water, and wherein emitting dusty air to the environment can be avoided or reduced.

According to an embodiment of the invention said working device is a separate module/implement, which can be easily attached to the vehicle and detached from a vehicle. This allows the use of the vehicle for multiple purposes, and the working device can be simple and relatively light without integrated drive or power generator facilities. However, as an alternative it is also possible to implement the invention with a working device which is integrated with a vehicle.

According to an embodiment of the invention, said means for separating comprises a blower for providing said underpressure and/or overpressure. This way it is possible to utilize one blower for three purposes, to keep the number of components small, and to have the device structure simple and light. However, as an alternative it is possible to use separate blowers.

According to an embodiment of the invention, the means for return of the separated air comprises a nozzle for providing an air knife. The nozzle may have a contracted dimension/cross-section of its aperture for increasing air flow velocity. Especially, the height dimension of the nozzle aperture (the smallest aperture dimension which is orthogonal to the horizontal nozzle width) may preferably be smaller than the diameter of the duct supplying air to the nozzle. Due to the high velocity of air, the air knife efficiently removes such extraneous material from the surface, which has not been removed by suction and brushing. The high air velocity is also efficient in moving and guiding the material to the brush located in front of the air knife. As an alternative, however, if an especially effective removal after suction and brushing is not required, it is possible to return the air to the surface treatment area without increasing the air velocity. It is preferable that the air velocity is higher at the middle and smaller at the side ends of the nozzle. This way it is possible to reduce the air coming out from the sides of the cleaning area.

According to an embodiment of the invention the air to be returned is directed to the surface and has a movement component in the intended movement direction of the working device. This direction of air movement has an advantage that the air knife removes the extraneous material from the surface and guides the removed material to the rotating brush.

According to an embodiment of the invention the flow provided by the underpressure and air suction with the extraneous material is arranged to be transported in a channel directed to cross over at least one said brush. This way it is possible to achieve the advantageous order for the phases of suction, brushing and air knife.

According to an embodiment of the invention the means for separating comprises a cyclone and/or another type of an elutriator. Using a cyclone brings several advantages. It does not require regular maintenance except emptying the collected dust. It is not necessary to provide changeable filters, for example. With a cyclone it is also possible to provide the underpressure required for suction, and to provide the overpressure required for the air knife. The cyclone has a small pressure drop and low consumption of energy, which are not affected by the amount of collected material.

According to an embodiment of the invention the means for separating and the vessel are located to the back of the treatment area of the surface in respect of the intended direction of movement. This way it is possible to have the treatment area at the front of the working device and it is possible clean surfaces close to obstacles like walls, fences and stairs.

According to an embodiment of the invention the vehicle assisted working device is designed to be located at the front of the assisting vehicle. This way the driver is able to see the device during driving and control its path of movement more accurately. However, it is also possible to design the working device for installation to the rear of the vehicle.

According to an embodiment of the invention the vehicle assisted working device has a part which is able to float in vertical direction respective to assisting vehicle. The floating part is supported to the ground by the brush and/or wheels. The floating part can thus follow an uneven surface of the ground and compensate the wearing of the brush. The floating part preferably comprises the brush and the air knife. The distance of the air knife can thus be kept on a constant, suitable distance from the ground independently of the form of the ground surface.

According to an aspect of the invention a method of cleaning surfaces with a mobile air-assisted collection device is disclosed.

According to an embodiment of the invention the material detached by the pressurized air from the surface is led to the brush and led further to the suction.

According to an embodiment of the invention the method comprises utilization of a small particle separation unit in a sub-unit of said separating unit. This embodiment has an advantage of further decreasing the amount of small particles that may spread to the environment.

According to a further aspect of the invention a system comprises a hosting vehicle and a working device.

Other embodiments of the invention are shown in the following text with reference to the figures showing further examples on the embodiments of the invention. It is clear to a skilled person in the art that shown measures, orders and topologies of the objects in the figures are not limited only to the shown form of examples, if not otherwise indicated. The embodiments are combinable in suitable part.

In this patent application "underpressure" means a pressure which has a lower magnitude than the ambient pressure. In a similar manner, "overpressure" means a pressure which has a higher magnitude than the ambient pressure. The ambient pressure means the pressure of air in the environment.

BRIEF DESCRIPTION OF DRAWINGS

In the following some embodiments of the invention are described with reference to the enclosed drawings, in which.

DETAILED DESCRIPTION OF PREFERRED EMBODIMENTS

Figure 1:
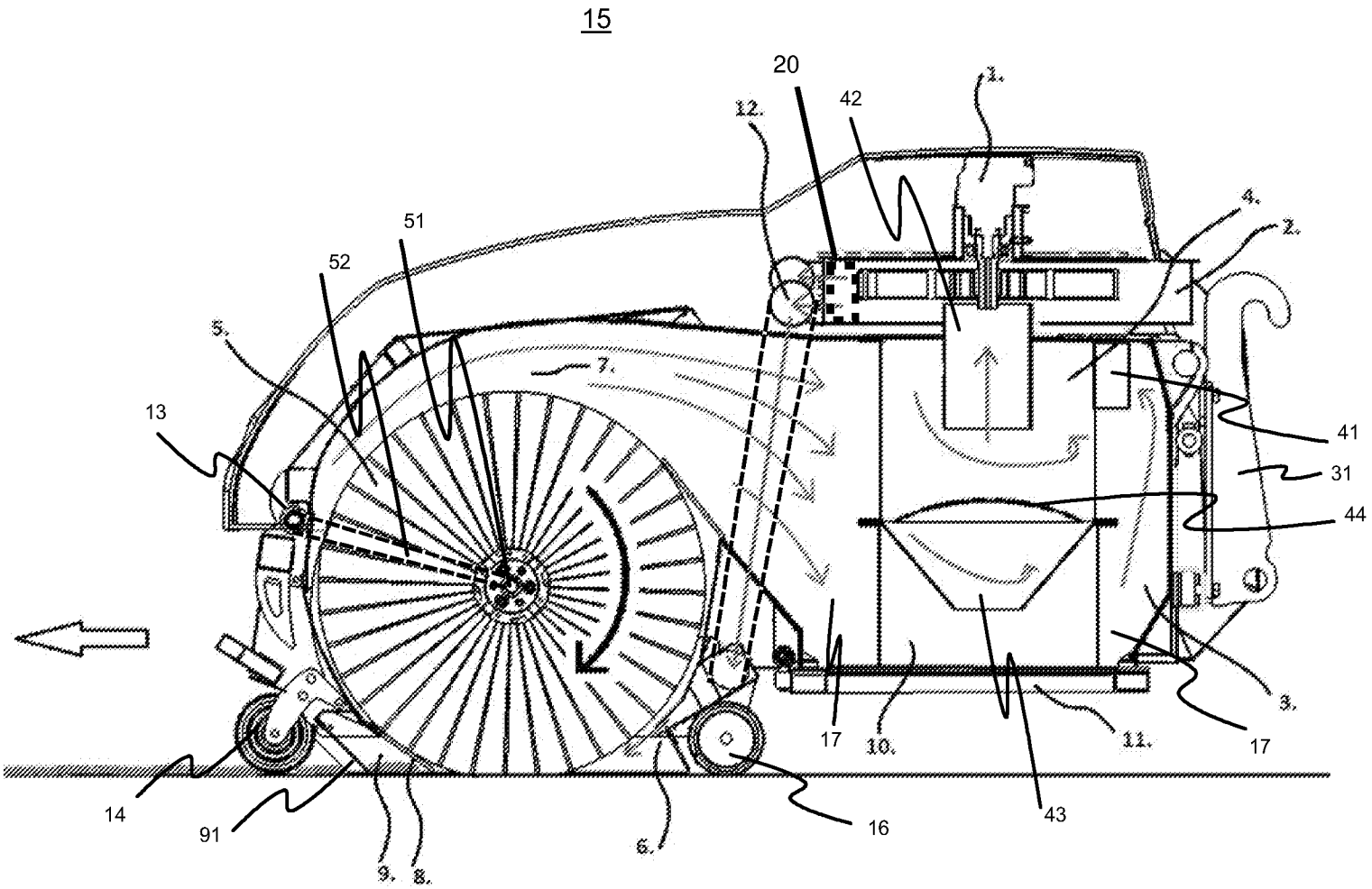
FIG. 1 illustrates an exemplary embodiment of a cleaning arrangement according to the invention as a cross-sectional view.

FIG. 1 shows an example of an embodiment of the invention for a vehicle assisted working device 15 for cleaning streets and similar surfaces from extraneous materials, such as sands. The main direction of device movement is shown with an arrow in front of the working device. According to an embodiment of the invention the working device comprises at least one brush 5 in a brush assembly, arranged to detach said extraneous material from said surface, i.e. street surface for example. This surface is given as an example of a horizontal or essentially horizontal type surfaces, into which type all the streets, squares and markets belong, which are sufficiently planar for a vehicle to access.

According to an embodiment of the invention, the working device can additionally comprise a smaller brush (not shown in Figure) in front of or beside the brush assembly. The additional brush has a vertical axis of rotation and it is addressed for cleaning at the edge of pavements on the streets. The additional brush may also have suction for collecting debris to the debris container vessel 10.

A brush assembly can comprise the brush 5, its support arm 52, and joints 13, 51 to hold the brush, and/or to guide its movement. According to an embodiment the brush assembly can also comprise at least one of the following, a hydraulic or electric motor for rotation of the brush, a wheel, pressure sensor, slip sleeve, chamber wall, air knife nozzle, and a suction channel.

In the working device there is also means 1, 2 for providing an underpressure for a suction 7 of the detached material (as being detached by the brush 5 and/or air-knife 6) into the air flow directing away from said surface at the detachment spot, means 4 for separating said detached material from said air flow, and means 1, 2 for providing an overpressure via tubing 12 for an air-knife 6 and return of the separated air to the surface via the air-knife 6.

In FIG. 1 the means for separating is embodied as a cyclone. The cyclone has the tangential flow inlet 41, a dished ground plate 44, end cone 43 and the air exit 42. The flows are illustrated by the arrows, to demonstrate the operation of the cyclone via the flows.

The brush 5 is arranged to rotate counter-wise to the intended direction of movement of the working device, in hosting device's guidance, so that the spot on the surface to be cleaned is treated by the working device in the order: means for the suction of the extraneous materials, at least one brush and means for return of the separated air to the surface. The intended direction of operation is indicated with a horizontal arrow pointing to left.

According to an embodiment, in the working device the underpressure is produced by a fan 2 or a blower 2, which has underpressure side at the intake inlet and an overpressure side at the outlet to the tubing 12, so providing respective means for making the underpressure and the overpressure. Making the needed underpressure for the suction is made via the garbage vessel 3, being achieved by the fan 2, but also by directing suction of the air flow along a suction channel 7 towards the garbage vessel 3. The underpressure condition reaches the lip sleeve 8 and the brush 5 co-operation point at the intake location. The underpressure is exposing also the brush contact spot to the surface to be brushed. The lip sleeve has approximately same width as the brush, and approximately reaches the ground surface to be cleaned and thus sweeps the ground surface. The lip sleeve and the brush are preferably in contact, whereby the brush moves the debris along the lip sleeve towards the channel 7. there is also an entrance chamber 9 at front of the lip sleeve 8 intake location. The entrance chamber has a front sleeve 91. The lip sleeve and the entrance chamber both prevent the debris from being thrown by the brush outside from the front of the device. They also restrict the suction volume and thus enhance the suction force at the brush in the entrance chamber area.

According to an embodiment the hosting vehicle assists the module/implement (as another system element) comprising the working device. The module can comprise also attachment means and/or mating means to the attachment means (not shown) so that the module can be attached and/or detached to the assisting vehicle, (or several assisting vehicles according to the attachment needs in each), acting as a hosting machine when the system of said system elements are operated together.

FIG. 1 shows a hydraulic motor 1 for the operating of the fan 2 or a blower 2, taking hydraulic operating power in suitable part from the hosting vehicle's hydraulic system. In an optional embodiment the motor can be pneumatic or electrical, also taking the power from the hosting vehicle. The motor for rotating the brush 5 can also be hydraulic, pneumatic or electric powered in similar way, in accordance of the power feed lines (not shown in the FIG. 1).

According to an embodiment the working device comprises attachment means 31 (see also FIG. 3) to attach the device to a host machine, which is provided with mating means to said attachment means. According to an embodiment of the invention the attachment means is configured to connect and relay from the host machine at least one of the following: a mechanical fixation, pull or push, hydraulic fluid flow to relay an assisting hydraulic pressure, and electric connection for power feed and/or signaling a control signal. It is possible that the attachment means also have e.g. hydraulic actuators for controlling the tilt angle of the working device. It is further possible that the fixed part of the working device has sensor(s) for measuring the distance to ground surface. A controller can then monitor the sensor outputs and control the tilt angle of the working device based on the form of the ground surface. This automatic tilt control allows additional compensation to ground forms so that a floating brush unit can have a smaller span of floating.

The working device has a container vessel 10 for the garbage that are collected and allowed to settle by the gravity in the vessel 10, which is indicated in FIG. 1. According to an embodiment variant the container vessel 10 comprises a lid 11 which can be closed/opened for holding/removing the debris. There may alternatively be a replaceable vessel and/or bag. The container vessel 10 is located below the cyclone. As an example of separating means 4, it has a cone. Above the cone there is drawn in the embodied cyclone a dished ground plate 44, which is meant for forces vortex reversal and to direct fine particulates to the hopper in the cyclone cone. Another task of the dished ground plate in this embodiment is to prevent already collected debris to get re-entrained by the cyclonic forces.

The drawing is only schematic and thus the measures or the geometry is not limiting the dimensions or their relation only to the shown example.

The cyclone can be positioned into the working device's inner volume 17, advantageously so that the tangential inlet of the cyclone 41 is as far as possible in the volume 17, so facilitating longest available settling time to the airborne debris in the volume 17, that extends from the brush housing or alike to the back wall near the embodied example of the cyclone inlet 41 location.

According to an embodiment of the invention the fan 2 or a blower 2 is arranged so that the same fan or blower 2 can be used for providing the underpressure, and overpressure to the line 12. For an optional air-knife arrangement comprising the means to implement the air knife 6, the overpressure side of the closed loop part can comprises also a pressurizing compressor 20 option as arranged to further increase the pressure for maximizing the pressure, the flow velocity through the air-knife nozzle to cause a shear force on the surface to be cleaned, when the air-knife nozzle is directed towards the surface to be cleaned. The air knife is arranged to provide a shear stress based cutting force to detach the debris from the surface to be cleaned. In the air-knife 6, the nozzle can have a contracted cross-section and/or a narrow slit for increasing air flow velocity for providing an air-knife action with the shear stress component directed on the surface. According to an embodiment using a slit, it can be implemented with an adjustable dimension of the slit. The nozzle 6, brush 5 and the suction interface 7-9 preferably have a substantially same width.

Although the fan 2 is arranged to provide air flow in a closed loop, according to an embodiment variant some volumetric proportion of the sucked air may be directed to the atmosphere, to balance the flow logistics. This way it is possible to keep the underpressure in the brushing area and thus reduce any emission of dusty air. Also, if the underpressure formed by the fan is also used for an additional brush, it is necessary to lead the corresponding amount of the sucked air to the atmosphere. According to an embodiment the releasable air is directed to the atmosphere via a secondary cleaning unit.

In an embodiment of the invention the overpressure side of the fan 2, the air in overpressure can be thus optionally fed via a conduit directly or via the pressurizer connected to the air-knife nozzle.

According to a further variant of the embodiment, the device comprises a conduit and/or a valve arranged to release at least part of the air coming from the fan into the atmosphere. According to an embodiment of the invention the release is arranged to happen instead of direct release, via a secondary cleaning unit, that removes from the air to be released, some further particulate matter before the release of the air.

According to an embodiment the secondary cleaning unit comprises an arrangement, where the airflow is directed into water, towards a water surface, so that particles from the air are suspended into the water to get settled therein in the water. According to an embodiment this arrangement as referred also as an impinger in the following, comprises the nozzle to be positioned in respect to the water surface so that the water surface is under the nozzle, below the nozzle, where the air directed for release is flowing, and the flow is directed towards to the water surface, whereby to make a sudden curve-linear turn. Although in this embodiment the collection efficiency as a particle size is influenced by the degree of the turbulence, the embodied operation can be understood on the terms of impaction theory in suitable part.

According to an embodiment variant the water surface in the secondary cleaning unit is arranged into the nozzle of the air flow or into the conduit feeding the nozzle, i.e. the air is fed underneath the water surface, so that the air flows through the water. Then soluble debris can get solved into the water, and the non-soluble debris part as suspended, settles down to the bottom by gravity.

According to an embodiment of the invention the secondary cleaning unit comprises a scrubber arranged to remove particles from the air flow before its exit into atmosphere.

The air-knife 6 arrangement comprises means to increase the pressure for forming a high velocity jet type flow, from a nozzle or slit system to direct a shear stress type force on to the surface, thus improving the cut off of the particles and/or debris from the surface, i.e. street. According to an embodiment of the invention the nozzle demonstrated in the FIG. 1 can be adjustable, so that the direction can be altered for improving the detachment of the debris, whereas in other embodiments the nozzle can be solidly mounted to a fixed position.

Because of the geometry, the air to be returned to the brushes via the air-knife arrangement is directed to the surface and the intended movement direction of the working device. According to an embodiment of the invention the angle of the flow and the surface is below 50 degrees, advantageously below 30 degrees but even more advantageously below 25 degrees. According to an embodiment of the invention the angle is more than 10 degrees, but even more advantageously more than 15 degrees. According to an embodiment the air knife arrangement comprises means to direct the air flow on to the surface to be cleaned in a working angle in respect to the surface to be cleaned.

According to an embodiment, the detached material from the surface at the lip sleeve 8 in the entrance chamber 9 is introduced into an underpressure channel 7 leading over the brush 5, so that the flow provided by the underpressure and con-sequent air suction causing the flow, the air flow with the extraneous material is arranged to be transported in a channel 7, which is directed to cross over at least one said brush 5. The slip sleeve 8 in the entrance chamber 9 is arranged so that the brush is actually pushing the debris to the channel 7, which expands when leading over the brush. In this embodiment the slip sleeve is arranged to tightly fit to the brush hairs (bristles) position at the very beginning of the channel 7, near the surface to be cleaned. This way the size of the channel can be more integral to the device structure and save space, but in addition the curve-linear motion of the enhancing flow also gives time to the suspended detached material to pre-settle. The surface to be cleaned is cleaned by at least one brush 5, which is embodied as a rotational brush lamellae comprising brush, which has its rotational axis parallel to the sur-face, but above it in the example of the embodiment. The debris from the surface detaches as large flocks rather than individual small particles, except loose debris as stones, sands or alike.

The heavier particles fall first, the finer fractions to be transported near to the opposite side of the vessel near the separator's (4) entrance. According to an embodiment of the invention cyclone is used as a separator. The vessel for the separated material and the cyclone are located to the backwards section of the device of the treatment area of the surface in respect of the intended direction of movement, for example.

According to an embodiment of the invention, the brush is mounted to be as a floating brush, i.e. the axle of the brush is so suspended that the brush hairs at the location of the surface to be cleaned is intercepting the surface to be cleaned. According to an embodiment, the brush is so suspended that the brush hairs twist because of the surface, at the end position of the hairs touching the surface to be cleaned. In this kind of embodiments the brush is suspended by an arm arrangement 51 and a joint 13, so that the brush can follow the surface accurately, but also to facilitate adjustment of the brush contact to the surface to be cleaned. This way it is also possible to take into account the brush hair wear out. Especially in such embodiments, where the slip sleeve end at the location of the surface to be cleaned is matched to the arm length for the purpose. The joint can comprise a motor and/or a locking device to a certain position of the arm.

According to an embodiment of the invention, the floating brush assembly comprising at least the brush 5, comprises also at least one wheel 14, 16, to be positioned in front (16) of the brush 5 and/or behind (14) the brush 5, so that the wheels 14, 16 are arranged to be not connected directly to the brush 5 so being enabled to float. According to an embodiment variant the wheels are suspended.

According to an embodiment of the invention the surface to be cleaned at the brush contacting area has been closed by a slip sleeve 8 at the front side of the brush 5, but according to a further variant optionally or in addition also from the rear and other sides of the brush 5.

According to an embodiment of the invention the separating means comprises a sub-separator or a sub-unit, which is arranged to remove smaller fractions of suspended particles, for instance small particles below 10 μm in diameter. Advantageously this sub-separator is situated after the cyclone 4, in series in respect of the flow exit 42 of the cyclone 4. In the shown example the air exit of the separating means is indicated with aligned arrows to the left, but a skilled man in the art knows, that other positions can be used in suitable part, depending on the elutriator type in use.

According to an embodiment an electrostatic precipitator, for example such as a variant of an old Cottrel-type can be used.

According to an embodiment of the invention the working device is designed to be located at the front of the assisting vehicle, but according to respective optional embodiments the device can be located to side or back of the hosting device.

Figure 4:
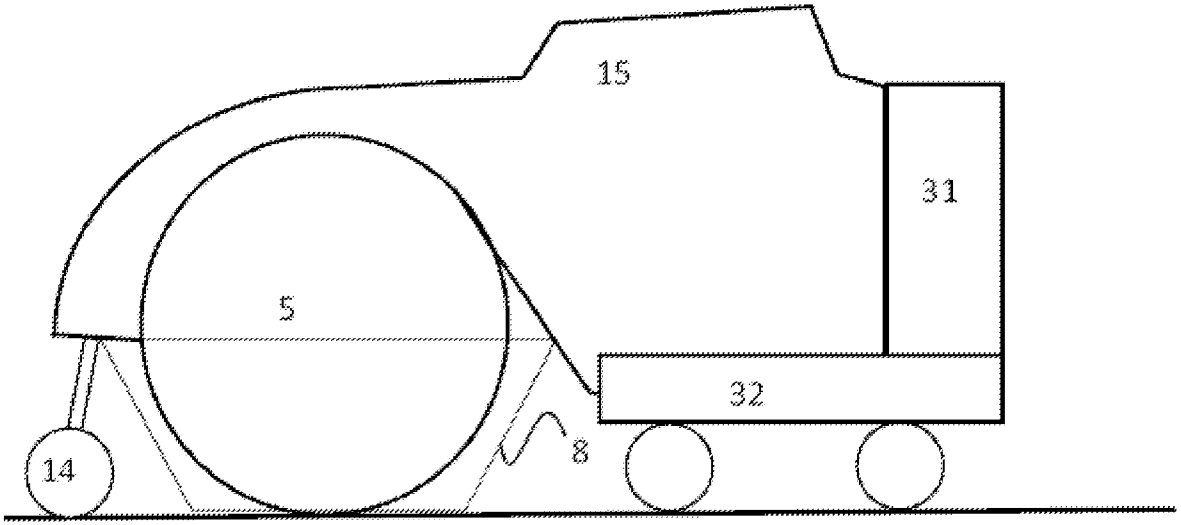
FIG. 4 illustrates schematically an exemplary embodiment of a mobile collection device, as embodies as an integrated composition of a self-driving robot vehicle and an embodied working device according to the invention.

In a variant of an embodiment of the invention illustrated in FIG. 4, the hosting machine can be a robot or remotely controlled vehicle or alike.

Figure 2:
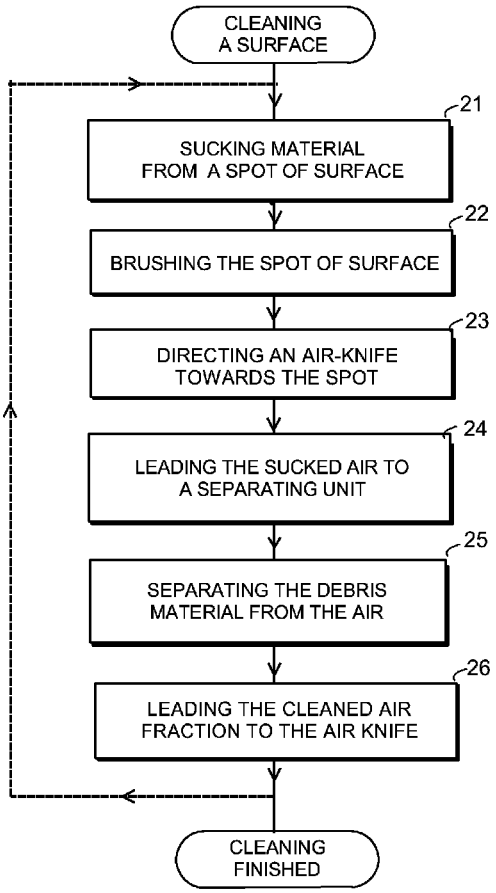
FIG. 2 illustrates an exemplary embodiment of a method according the invention as a flow diagram.

According to an embodiment of the method, such surfaces as streets, squares and market places can be cleaned from sand with a vehicle assisted working device according to an embodiment of the invention operating according to the following method with the ensemble of method steps as demonstrated in FIG. 2.

According to an embodiment of the method of cleaning surfaces with a vehicle assisted working device, the method comprises method steps for

- sucking 21 air in aligned direction of the brush rotation at the surface side of rotation,
- brushing 22 with a rotatable brush said surface in a counter direction of the movement of the vehicle assisted working device,
- directing 23 pressurized air-knife towards the surface to be cleaned for detachment of debris by the caused shear stress,
- leading 24 the sucked air with the detached debris into the separating unit,
- separating 25, in the separator acting as a separating unit a debris fraction from the air,
- circulating 26 back the cleaned air fraction to the circulation as return air.

A spot of a surface is treated in the order: sucking, brushing and directing pressurized air. In a preferred embodiment, material detached by the pressurized air from the surface is led to the brushing and led further to the suction.

A skilled person in the art knows, that some of the shown method steps can be occurring at least some part in parallel and/or in a different order.

According to an embodiment variant the vehicle assisted working device is a separate module to be attached and/or detached to the vehicle that is assisting the working device as hosting machine. According to an embodiment of the invention the module variant is designed for fixation by attachment means to attach to the hosting machine, and its electrical, hydraulic and/or pneumatic system in suitable part, also in an embodiment variant in which the module is permanently fixed via the attachment means. According to an embodiment the attachment means comprise also mechanical support and/or parts to relay the push/pull force as an operating force from the hosting machine.

Figure 3:
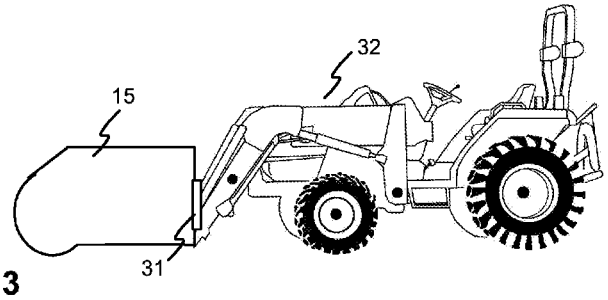
FIG. 3 illustrates an exemplary embodiment of a cleaning system according to the invention.

FIG. 3 illustrates system according to an embodiment of the invention wherein the working device 15 comprises attachment means 31 to attach the device to a host machine 32. The host machine is embodied as a tractor in FIG. 3, but also different kind of vehicles that have the mating means to the attachment means will do. Alternatively in an embodiment the attaching means can be comprised in the host machine and the suitable mating means in the working device. In addition to the mechanical attachment of the working device, there is also a hydraulic connection and/or some other power connection between the host vehicle and the working device. This is used for supplying energy for the brush motor and the air blower. The position of the working device is shown as an example, without intention to limit the system topology only to the shown example.

The working device is embodied as a vehicle assisted module for cleaning streets or alike surfaces. According to an embodiment of the invention such a working device is a mobile collection device, wherein the device comprises: a closed loop air circulating fluid suction arrangement for producing suction, a collector unit to clean the fluid sucked, an air-knife arrangement to produce a shear stress directable on to the debris on the surface to be cleaned, a rotating brush arrangement, arranged to comprise at least one brush rotatable in alignment of said suction, in a counter direction of the planned movement of the device, a fluid guide to guide said fluid sucked onwards on a curved surface of said fluid guide for improvement of the fluid flow into the collector unit.

According to an embodiment the module is attachable to a vehicle acting as a host machine by attachment means, the vehicle can be at least one of the following: A car, a tractor, a wheel loader, a tram, and a lorry.

According to an embodiment of the invention the fixation to the host machine is made permanent. In a further embodiment the system comprising the host vehicle and the working device is scaled down to the size of a hoover, wherein the host vehicle is at least partly an autonomously self-driving robot vehicle, illustrated in FIG. 4, arranged to cleaning surfaces in the poisonous or radioactive environments for example.

In an embodiment of the invention the separator 4 comprises at least one of the following: A cyclone, a classical cyclone, a Lapple type cyclone, a Thien type cyclone, a combination of at least two of the mentioned cyclones and a cyclone train comprising only one type of said cyclone types.

In an embodiment of the invention the brush arrangement comprises at least one brush 5 with a horizontal rotating axis, but in some embodiments the brush arrangement may have at least one additional brush with vertical rotating axis.

In an embodiment of the invention the air flow of the air-knife is a constant air flow, but in an optional embodiment a pulsating air shock flow, maintained with an oscillating on-off valve, for example.

A system according to an invention comprises a host vehicle and a working device. According to a further embodiment the system comprises control means to control said vehicle in suitable part.

Above some exemplary devices according to the invention have been described. The principle of the invention can naturally be modified within the scope of protection determined by the patent claims, e.g. in details of implementation and areas of use.

The invention claimed is:

1. A mobile collection device comprising:

a vehicle assisted working device configured to clean a street surface or similar surface from extraneous materials, the vehicle assisted working device comprising at least one brush for detachment of said extraneous material from said street surface or the similar surface, said at least one brush being configured to rotate counter-wise to a forward movement direction of the working device, the at least one brush comprising brush bristles configured to contact the street surface or the similar surface, by motion or relative position of the at least one brush, and at least one blower having a suction side and a pressure side, the suction side being configured along an airflow path to provide an underpressure for suction of the detached material into the air flow path from said street surface or similar surface, that airflow within the airflow path passes over the at least one counter-rotating brush and the air flow is directed to the at least one blower via a cyclone positioned in the airflow path and under the at least one blower, the cyclone being disposed at a rear portion of the body, the cyclone being configured to separate said detached material from said air flow, the air flow being constituted by the suction at the suction side of the blower, the at least one blower being further configured to provide an overpressure at the pressure side of the blower and return of the separated air to said street surface or similar surface through an air-knife; and an autonomously self-driving robot vehicle integrated together with the vehicle assisted working device to form the mobile collection device, wherein, the working device is configured such that when the working device is moved over a spot of street surface or similar surface to be cleaned, the spot is treated in the following order: the at least one blower provides the underpressure for the suction of the detached extraneous materials, said at least one counter-rotating brush brushes the spot and then the at least one blower provides the overpressure and return of the separated air to the street surface or similar surface via the air-knife.

2. The mobile collection device of claim 1, wherein said working device is a separate module/implement configured to be one or more of attached and detached to/from the vehicle.

3. The mobile collection device of claim 1, wherein the cyclone is configured to allow the air to from the underpressure side of the blower through the cyclone to the suction location of the blower.

4. The mobile collection device of claim 1, wherein the at least one blower is configured to produce the overpressure to an overpressure side by its own operation or by assistance from a pressurizer to feed the air-knife.

5. The mobile collection device of claim 1, further comprising a nozzle with a contracted cross-section to increase air flow velocity to provide an air-knife operation based on a shear stress based cutting force to detach the debris from the street surface or similar surface to be cleaned.

6. The mobile collection device of claim 5, wherein the air to be returned is directed to the street surface or similar surface via said air-knife and has a movement component in the forward movement direction of the working device.

7. The mobile collection device of claim 1, wherein the air flow provided by the underpressure and air suction with the extraneous material is transported in a channel directed to cross over the at least one brush.

8. The mobile collection device of claim 1, further comprising a lip sleeve in front of the at least one brush, the lip sleeve being configured to sweep the street surface or similar surface and the at least one brush is configured to sweep the lip sleeve.

9. The mobile collection device of claim 1, wherein the working device further comprises a fixed part, which is substantially supported by the autonomously self-driving robot vehicle, and a floating part, which is at least partly supported to the street surface or similar surface and is configured to move vertically with respect to the fixed part in order to follow the form of the street surface or similar surface to be cleaned.

10. The mobile collection device of claim 9, wherein the floating part comprises the at least one brush and the air-knife.

11. A system for cleaning streets and similar surfaces from extraneous materials, the system comprising:

a mobile collection device comprising a vehicle assisted working device configured to clean a street surface or similar surface from extraneous materials, the vehicle assisted working device comprising at least one brush for detachment of said extraneous material from said street surface or the similar surface, said at least one brush being configured to rotate counter-wise to a forward movement direction of the working device, the at least one brush comprising brush bristles configured to contact the street surface or the similar surface, by motion or relative position of the at least one brush, and at least one blower having a suction side and a pressure side, the suction side being configured along an airflow path to provide an underpressure for suction of the detached material into the air flow path from said street surface or similar surface, that airflow within the airflow path passes over the at least one counter-rotating brush and the air flow is directed to the at least one blower via a cyclone positioned in the airflow path and under the at least one blower, the cyclone being disposed at a rear portion of the body, the cyclone being configured to separate said detached material from said air flow, the air flow being constituted by the suction at the suction side of the blower, the at least one blower being further configured to provide an overpressure at the pressure side of the blower and return of the separated air to said street surface or similar surface through an air-knife; and an autonomously self-driving robot vehicle integrated together with the vehicle assisted working device to form the mobile collection device, wherein, the working device is configured such that when the working device is moved over a spot of street surface or similar surface to be cleaned, the spot is treated in the following order: the at least one blower provides the underpressure for the suction of the detached extraneous materials, said at least one counter-rotating brush brushes the spot and then the at least one blower provides the overpressure and return of the separated air to the street surface or similar surface via the air-knife, wherein the autonomously self-driving robot vehicle is configured to be detached from the vehicle assisted working device such that the vehicle assisted working device is configured to attach to another vehicle other than the autonomously self-driving robot vehicle.

12. A method of cleaning a surface with a mobile collection device including a vehicle assisted working device configured to clean a street surface or similar surface from extraneous materials, the vehicle assisted working device including at least one brush for detachment of said extraneous material from said street surface or the similar surface, said at least one brush being configured to rotate counter-wise to a forward movement direction of the working device, the at least one brush comprising brush bristles configured to contact the street surface or the similar surface, by motion or relative position of the at least one brush, and at least one blower having a suction side and a pressure side, the suction side being configured along an airflow path to provide an underpressure for suction of the detached material into the air flow path from said street surface or similar surface, that airflow within the airflow path passes over the at least one counter-rotating brush and the air flow is directed to the at least one blower via a cyclone positioned in the airflow path and under the at least one blower, the cyclone being disposed at a rear portion of the body, the cyclone being configured to separate said detached material from said air flow, the air flow being constituted by the suction at the suction side of the blower, the at least one blower being further configured to provide an overpressure at the pressure side of the blower and return of the separated air to said street surface or similar surface through an air-knife, and an autonomously self-driving robot vehicle integrated together with the vehicle assisted working device to form the mobile collection device, wherein, the working device is configured such that when the working device is moved over a spot of street surface or similar surface to be cleaned, the spot is treated in the following order: the at least one blower provides the underpressure for the suction of the detached extraneous materials, said at least one counter-rotating brush brushes the spot and then the at least one blower provides the overpressure and return of the separated air to the street surface or similar surface via the air-knife, the method comprising:

sucking air by the blower from the underpressure side in an aligned direction of brush rotation of the rotatable brush;

brushing with the at least one rotatable brush said street surface or similar surface in a counter direction of the forward movement direction of the autonomously self-driving robot vehicle;

directing pressurized air from the blower pressure side via piping to the air-knife, from which towards the surface to be cleaned for detachment of debris;

leading sucked air at the underpressure side of the blower with the detached debris into the cyclone;

separating, in the cyclone, a debris fraction from the air; and circulating back a cleaned air fraction to the circulation via the blower as return air for providing the pressurized air for the air-knife, wherein the spot of the street surface or similar surface is treated cooperatively in the following order: sucking, brushing, and directing the pressurized air via the air-knife.

13. The method of claim 12, wherein material detached by the pressurized air via the air-knife as detached from the street surface or similar surface to be cleaned is led to the brushing and led further to the suction at the least one brush contacting the street surface or similar surface.

* * * * *